US009989303B1

(12) United States Patent
Demiroez et al.

(10) Patent No.: US 9,989,303 B1
(45) Date of Patent: Jun. 5, 2018

(54) REFRIGERATION DEVICE COMPRISING A TRANSPORT SECURING ELEMENT

(71) Applicant: BSH HAUSGERAETE GMBH, Munich (DE)

(72) Inventors: Taha Demiroez, Tekirdag (TR); Ibrahim Levent Altay, Tekirdag (TR); Ercan Engin, Tekirdag (TR)

(73) Assignee: BSH Hausgeraete GmbH, Munich (DE)

( * ) Notice: Subject to any disclaimer, the term of this patent is extended or adjusted under 35 U.S.C. 154(b) by 0 days. days.

(21) Appl. No.: 15/366,177

(22) Filed: Dec. 1, 2016

(51) Int. Cl.

| | |
|---|---|
| ***A47B 96/04*** | (2006.01) |
| ***F25D 29/00*** | (2006.01) |
| ***F25D 25/02*** | (2006.01) |
| ***F25D 23/08*** | (2006.01) |

(52) U.S. Cl.
CPC ..... *F25D 29/006* (2013.01); *F25D 23/08* (2013.01); *F25D 25/02* (2013.01)

(58) Field of Classification Search
CPC ..... F25D 29/006; F25D 23/08; F25D 25/02
See application file for complete search history.

(56) References Cited

U.S. PATENT DOCUMENTS 2,659,648 A * 11/1953 Robbins ..... B65D 85/68 206/320
4,848,581 A * 7/1989 Besore ..... B65D 59/00 206/320
5,435,441 A * 7/1995 Tiedt ..... B29C 44/16 206/320
8,646,857 B2 * 2/2014 Schillkowski ..... F25D 23/00 312/401
9,534,832 B2 * 1/2017 Moon ..... F25D 23/04
2007/0090243 A1 * 4/2007 Downing ..... A47B 96/068 248/235
2013/0313958 A1 * 11/2013 Moon ..... F25D 23/04 312/404
2014/0217871 A1 * 8/2014 Kerner ..... F25D 25/024 312/236

FOREIGN PATENT DOCUMENTS

| | | | |
|---|---|---|---|
| DE | 19621542 | A1 * | 12/1997 |
| DE | 102008016474 | A1 | 10/2009 |
| WO | 2014017067 | A1 | 1/2014 |

* cited by examiner

*Primary Examiner* — Hanh V Tran
(74) *Attorney, Agent, or Firm* — Laurence A. Greenberg; Werner H. Stemer; Ralph E. Locher

(57) ABSTRACT

A refrigeration device having a heat-insulated inner container, which is configured to delimit a cooling chamber for storing refrigerated goods, wherein the inner container has a lateral container wall. The refrigeration device includes a shelf mounted on the inner container, wherein the shelf has a lateral shelf edge, and a transport securing element for securing the shelf during transport of the refrigeration device, wherein the transport securing element is positioned between the lateral container wall and the lateral shelf edge, and wherein the transport securing element is formed with a recess, which is configured to enclose the lateral shelf edge.

16 Claims, 5 Drawing Sheets

REFRIGERATION DEVICE COMPRISING A TRANSPORT SECURING ELEMENT

The present disclosure relates to a transport securing element of a refrigeration device.

BACKGROUND OF THE INVENTION

A refrigeration device can be used to store a variety of refrigerated goods in a cooling chamber at reduced temperature. Several shelves are typically positioned within the cooling chamber, wherein the refrigerated goods can be placed on these shelves. Since the shelves are typically composed of glass, which can break during transport of the refrigeration device, it is necessary to provide means for securing the shelves during transport. In conventional refrigeration devices, the shelves are typically temporarily secured by packing taping. However, such temporary fixation of shelves cannot always guarantee a proper fixation of shelves during transport, and therefore damaging the shelves cannot be fully excluded.

In WO 2014/17067 A1, a transport securing element of a refrigeration device for securing shelves during transport is disclosed. The transport securing element is connected to front edges of the respective shelves.

In DE 10 2008 016 474 A1, a comb part of a refrigeration device for securing shelves during transport is disclosed. The clamping slots of the comb part are connected to front edges of the respective shelves.

BRIEF SUMMARY OF THE INVENTION

It is an object of the present disclosure to provide an efficient and convenient-to-use transport securing element for securing shelves within a cooling chamber of a refrigeration device.

This object is achieved by way of the features of the independent patent claim. Further developments are the subject matter of the dependent claims, the description and the appended figures.

The present disclosure is based on the finding that the above object can be achieved by positioning a transport securing element between a lateral shelf edge of a shelf and a lateral container wall of an inner container of the refrigeration device such that a recess of the transport securing element can enclose the lateral shelf edge of the shelf. In doing so, the transport securing element can be positioned between the lateral container wall and the lateral shelf edge, thereby reducing the required space. Furthermore, besides protecting the shelf the transport securing element can also protect a shelf bar positioned at the lateral shelf edge of the shelf.

A refrigeration device according to the present disclosure may refer in particular to a domestic, house-hold refrigeration device, which includes any refrigeration device, which is used in the house-hold in homes or in gastronomy. The refrigeration device functions to store food and/or beverages at certain temperatures, and comprises a refrigerator, a freezer, a chest freezer, a fridge-freezer-combination, an ice-box or a wine fridge.

According to an aspect, the present disclosure relates to a refrigeration device having a heat-insulated inner container, which is configured to delimit a cooling chamber for storing refrigerated goods, wherein the inner container comprises a lateral container wall, the refrigeration device comprising a shelf mounted on the inner container, wherein the shelf comprises a lateral shelf edge, and a transport securing element for securing the shelf during transport of the refrigeration device, wherein the transport securing element is positioned between the lateral container wall and the lateral shelf edge, and wherein the transport securing element comprises a recess, which is configured to enclose the lateral shelf edge.

The term "lateral" shall refer to such walls or edges which are aligned essentially parallel to a front to rear direction, i.e. a depth direction, when standing in front of the refrigeration device which is placed into a position for its intended use. For example a lateral container wall can be a left container wall or a right container wall.

As a result of the transport securing element, the shelf is secured inside the cooling chamber, thereby reducing the risk of damaging the shelf during transport of the refrigeration device. By enclosing the lateral shelf edge, the recess of the transport securing element may provide a firm contact between the transport securing element and the shelf, thereby preventing an accidental release of the shelf during transport. The transport securing element is positioned between the lateral container wall and the lateral shelf edge, therefore efficiently using the available space within the cooling chamber without obstructing the view from the front of the refrigeration device into the cooling chamber which may be advantageous when the refrigeration device is exhibited at a point of sale. Moreover, the transport securing element does not protrude into the available space between a shelf front facing towards the refrigerator door and the refrigerator door in a closed state of the refrigerator door. Eventually, the transport securing element may be designed more freely, in particular less dependent on the design of the inner door, i.e. the types and number of door bins installed, since the transport securing element may not have to be in contact with these at all.

The recess of the transport securing element, which is configured to enclose the lateral shelf edge, may in particular encompass the lateral shelf edge from top and/or from bottom.

The recess shall enclose at least a section of the lateral shelf edge, in particular in depth direction.

The transport securing element may additionally be configured to enclose the front shelf edge and/or a rear shelf edge. According to one example, however, the transport securing element is configured to only enclose the lateral shelf edge. In particular the transport securing element may be positioned in depth direction with a distance to the front shelf edge and the rear shelf edge.

According to one example, the recess comprises an inner wall or inner closing, which abuts against the lateral shelf edge. The inner wall of the recess may in particular be a lateral surface of the recess. By abutting against the inner wall of the recess, the shelf, when inserted in the recess, cannot move further towards the inner wall of the recess, thereby allowing for an efficient fixation of the shelf within the recess. Alternatively, there may be a gap between the inner wall of the recess and the lateral shelf edge. This may allow a simple mounting of the transport securing element and yet limits the possible movement of the shelf.

According to one example, the shelf comprises an upper surface and a lower surface, wherein the shelf comprises a shelf bar, which is positioned at the lower surface, wherein the recess comprises an upper wall, which abuts against the upper surface, and wherein the recess comprises a lower wall, which abuts against the shelf bar. As a result, the shelf is squeezed between the upper wall and the lower wall of the recess, therefore ensuring a proper fixation of the shelf within the recess. Alternatively, there may be a gap between the upper wall of the recess and the upper surface of the shelf and/or a gap between the lower wall of the recess and the shelf bar. This may allow a simple mounting of the transport securing element and yet limits the possible movement of the shelf.

According to one example, the shelf bar comprises an upper surface, which is connected to the lower surface of the shelf, and wherein the lower wall of the recess abuts against a lower surface of the shelf bar. As a result, since the lower wall of the recess abuts against the lower surface of the shelf bar, the shelf bar is well protected from any damage within the recess of the transport securing element.

According to one example, the shelf comprises a shelf mount, which is configured to mount the shelf on a rear container wall of the inner container. As a result, the shelf mount ensures a proper fixation of the shelf at the rear container wall. The shelf may only be mounted to the rear container wall. In particular, the shelf may not be mounted to lateral container walls. Between the lateral shelf edge and the lateral container wall may be a gap, for example extending from a front edge of the shelf essentially up to a rear edge of the shelf.

According to one example, the shelf comprises a lower surface and a rear edge, and wherein the shelf mount is connected to the lower surface and/or the rear edge. As a result, by connecting the shelf mount to the lower surface and the rear edge of the shelf, a solid connection between the shelf and shelf mount is achieved.

According to one example, the transport securing element comprises a lateral side, which abuts against the lateral container wall. As a result, the contact between lateral container wall and the lateral side ensures an efficient fixation of the transport securing element inside the cooling chamber in a direction perpendicular to the depth direction, e.g. in a width direction.

According to one example the transport securing element comprises a top surface which abuts against a top blocking element of the refrigeration device. This top blocking element may for example be a top wall of the inner container, a further shelf or an evaporator cover. According to one example, an evaporator cover sheet for covering an evaporator chamber of the refrigeration device is mounted on a top container wall of the inner container, wherein the transport securing element comprises a top surface, which abuts against the evaporator cover sheet. As a result, the contact between the evaporator cover sheet and the top blocking element ensures an efficient top fixation of the transport securing element inside the cooling chamber.

According to one example the transport securing element comprises a bottom surface which abuts against a bottom blocking element of the refrigeration device. This bottom blocking element may for example be a bottom wall of the inner container or a further shelf. According to one example, the refrigeration device comprises a bottom shelf, which is fixed to the inner container, wherein the transport securing element comprises a bottom surface, which abuts against an upper surface of the bottom shelf. As a result, the contact between the bottom blocking element and bottom surface of the transport securing element ensures a proper bottom fixation of the transport securing element inside the cooling chamber.

According to one example, the shelf comprises a lateral extension between a front edge and a rear edge of the shelf, wherein the transport securing element comprises a lateral extension between a front side and a rear side of the transport securing element, and wherein the lateral extension of the transport securing element is smaller than the lateral extension of the shelf. As a result, due to the smaller lateral extension, the transport securing element can be efficiently positioned at the lateral shelf edge, while the transport securing element does not protrude into the space between the front edge of the shelf and the refrigerator door and/or the transport securing element may be simple to produce. For example the lateral extension of the transport securing element may essentially be less than a half or a third or a quarter of the lateral extension of the shelf.

According to one example, the shelf comprises a deco strip, which is positioned at a front edge of the shelf. The transport securing element may be positioned in depth direction behind the deco strip. In this way the shelf can be sufficiently supported without the risk of damaging the deco strip which could occur when encompassing or clamping the deco strip.

According to one example, the refrigeration device comprises an additional transport securing element, wherein the shelf comprises an additional lateral shelf edge opposite to the lateral shelf edge, wherein the inner container comprises an additional lateral container wall opposite to the lateral container wall, wherein the additional transport securing element is positioned between the additional lateral container wall and the additional lateral shelf edge, and wherein the additional transport securing element comprises an additional recess, which is configured to enclose the additional lateral shelf edge. As a result, due to the additional transport securing element, which is positioned essentially opposite to the transport securing element inside the cooling chamber, the shelf is protected at both lateral shelf edges. Therefore, the shelf may be pressed against both the transport securing element and the additional transport securing element or may have a sufficiently small gap with respect to the transport securing element and the additional transport securing element, which ensures an efficient fixation of the shelf.

According to one example, the transport securing element and/or the additional transport securing element is made at least partially or completely of plastic. In particular the transport securing element and/or the additional transport securing element may comprise a thermoplastic, in particular expanded polystyrene (EPS). As a result, elastic properties can be obtained, which allow the respective transport securing element to be aligned to the shelf, thereby ensuring a flexible and stable connection between shelf and the respective transport securing element.

According to one example, the refrigeration device comprises a further shelf mounted on the inner container, wherein the transport securing element is positioned between the lateral container wall and a further lateral shelf edge of the further shelf, and wherein the transport securing element comprises a further recess, which is configured to enclose the further lateral shelf edge. As a result, by the recess and the further recess, the transport securing element enables to fix both the shelf and the further shelf within the cooling chamber. In particular, the transport securing element can be configured to fix the shelf, and a plurality of further shelves, e.g. two further shelves. Therefore, by a single transport securing element a plurality of shelves can be secured within the cooling chamber.

According to one example, the refrigeration device comprises a further shelf mounted on the inner container, wherein the additional transport securing element is positioned between the additional lateral container wall and a further additional lateral shelf edge of the further shelf, and wherein the additional transport securing element comprises an additional further recess, which is configured to enclose the further additional lateral shelf edge. In particular, the transport securing element can be configured to fix the shelf, and a plurality of further shelves, e.g. two further shelves. As a result, multiple further shelves in the cooling chamber can be protected at their lateral shelf edges inside the cooling chamber.

BRIEF DESCRIPTION OF THE DRAWINGS

Further examples of the principles and techniques of that disclosure are explained in greater detail with reference to the appended drawings, in which.

DETAILED DESCRIPTION OF THE DRAWINGS

Figure 1:
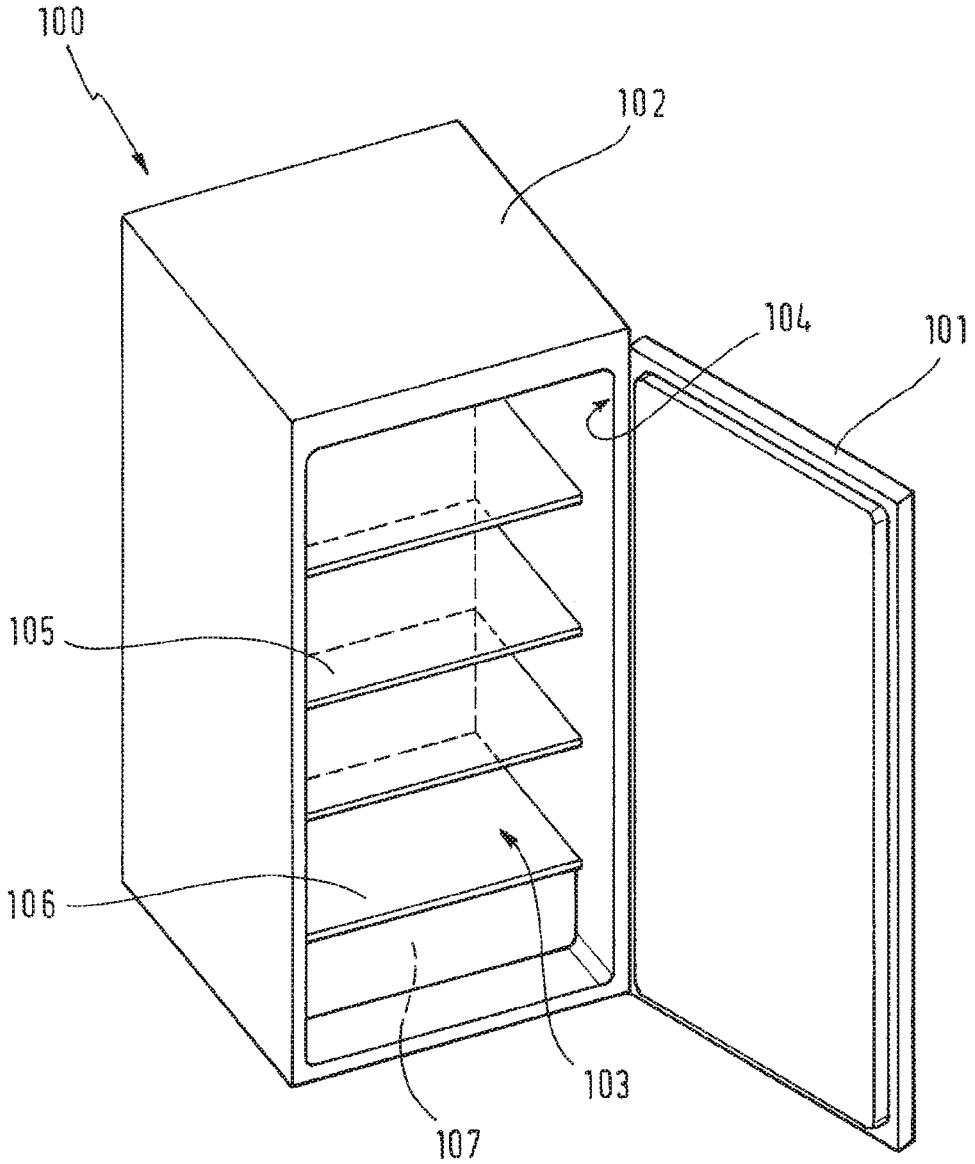
FIG. 1 shows a schematic representation of a refrigeration device.

FIG. 1 shows a schematic representation of a refrigeration device according to the principles described herein. The refrigeration device 100 comprises a refrigerator door 101 and a refrigerator casing 102, wherein the refrigerator door 101 closes a cooling chamber 103 of the refrigeration device 100. The refrigeration device 100 comprises a heat-insulated inner container 104, which is configured to delimit the cooling chamber 103. Therefore, when the refrigerator door 101 is closed, refrigerated goods can be efficiently stored in the cooling chamber 103 at reduced temperature by operation of a refrigerant circuit of the refrigeration device 100.

Such refrigerated goods can be placed on shelves 105, which are mounted on the inner container 104. A bottom shelf 106 is typically fixed to the inner container 104, wherein the bottom shelf 106 encloses a bottom cooling space 107 of the cooling chamber 103. Such bottom cooling space 107 allows for a separate storage of specific refrigerated goods, such as vegetables or fruits.

Figure 2:
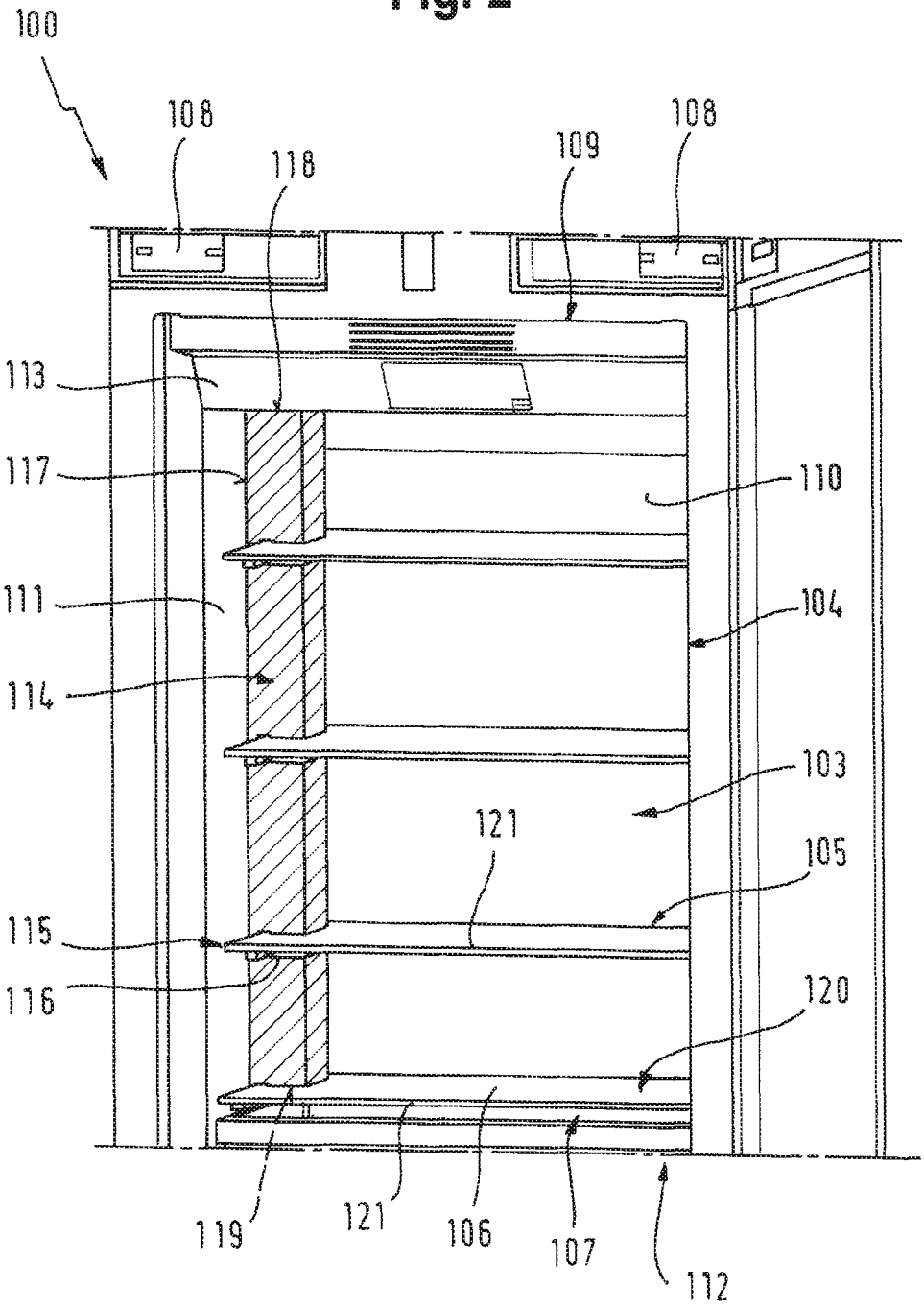
FIG. 2 shows a schematic representation of a cooling chamber of a refrigeration device.

FIG. 2 shows a schematic representation of a cooling chamber of a refrigeration device. A refrigerator door 101, which can be attached to door hinges 108 of the refrigeration device 100, is not depicted in FIG. 2.

A cooling chamber 103 of the refrigeration device 100 is delimited by a heat-insulated inner container 104. The inner container 104 comprises a top container wall 109, a rear container wall 110, a lateral container wall 111 which in this case is the left container wall when viewed in a front to rear direction when standing in front of the refrigeration device, and a bottom container wall 112, wherein the latter is only schematically depicted in FIG. 2.

An evaporator cover sheet 113 is mounted on the top container wall 109, wherein the evaporator cover sheet 113 is configured to cover an evaporator chamber of the refrigeration device 100. A bottom shelf 106, which is fixed to the inner container 104, encloses a bottom cooling space 107 of the cooling chamber 103. Such bottom cooling space 107 allows for a separate storage of specific refrigerated goods, such as vegetables or fruits.

Refrigerated goods can be placed on a shelf 105, which is mounted on the inner container 104. To protect the shelf 105, which may partially consist of glass, a transport securing element 114 is positioned between a lateral shelf edge 115 of the shelf 105 and the lateral container wall 111. The transport securing element 114 comprises a recess 116, which is configured to enclose the lateral shelf edge 115. The transport securing element 114 comprises a lateral side 117, which abuts against the lateral container wall 111, comprises a top surface 118, which abuts against the evaporator cover sheet 113, and comprises a bottom surface 119, which abuts against an upper surface 120 of the bottom shelf 106.

The transport securing element 114 comprises a polymer, in particular expanded polystyrene (EPS). An elastic polymer, such as EPS, enables efficient shock absorption during transport of the refrigeration device 100, and due to its porous structure comprises a reduced weight and therefore does not significantly increase the total weight of the refrigeration device 100.

Therefore, the transport securing element 114 is effectively positioned between a lateral shelf edge 115 of the shelf 105 and the lateral container wall 111, allowing for an efficient fixation of the shelf 105 during transport of the refrigeration device 100. It is therefore possible to refrain from using temporary fixation methods, such as using packing taping for fixation of the shelf 105. Consequently, the probability of damaging any shelf 105, in particular glass shelf 105, during transport of the refrigeration device 100 is significantly reduced.

Furthermore, the transport securing element 114 can be efficiently inserted into a gap between the lateral container wall 111 and the lateral shelf edge 115, therefore efficiently using the available space within the cooling chamber 103.

Consequently, the transport securing element 114 is not in contact with a front edge 121 of the shelf 105, thereby guaranteeing an unobstructed view from the front of the refrigeration device 100 into the cooling chamber 103. Moreover, the transport securing element 114 does not protrude into the available space between the front edge 121 and the refrigerator door 101, thereby allowing for an universal design of the transport securing element 114 regardless of the available space between the front edge 121 and the refrigerator door 101.

Figure 3:
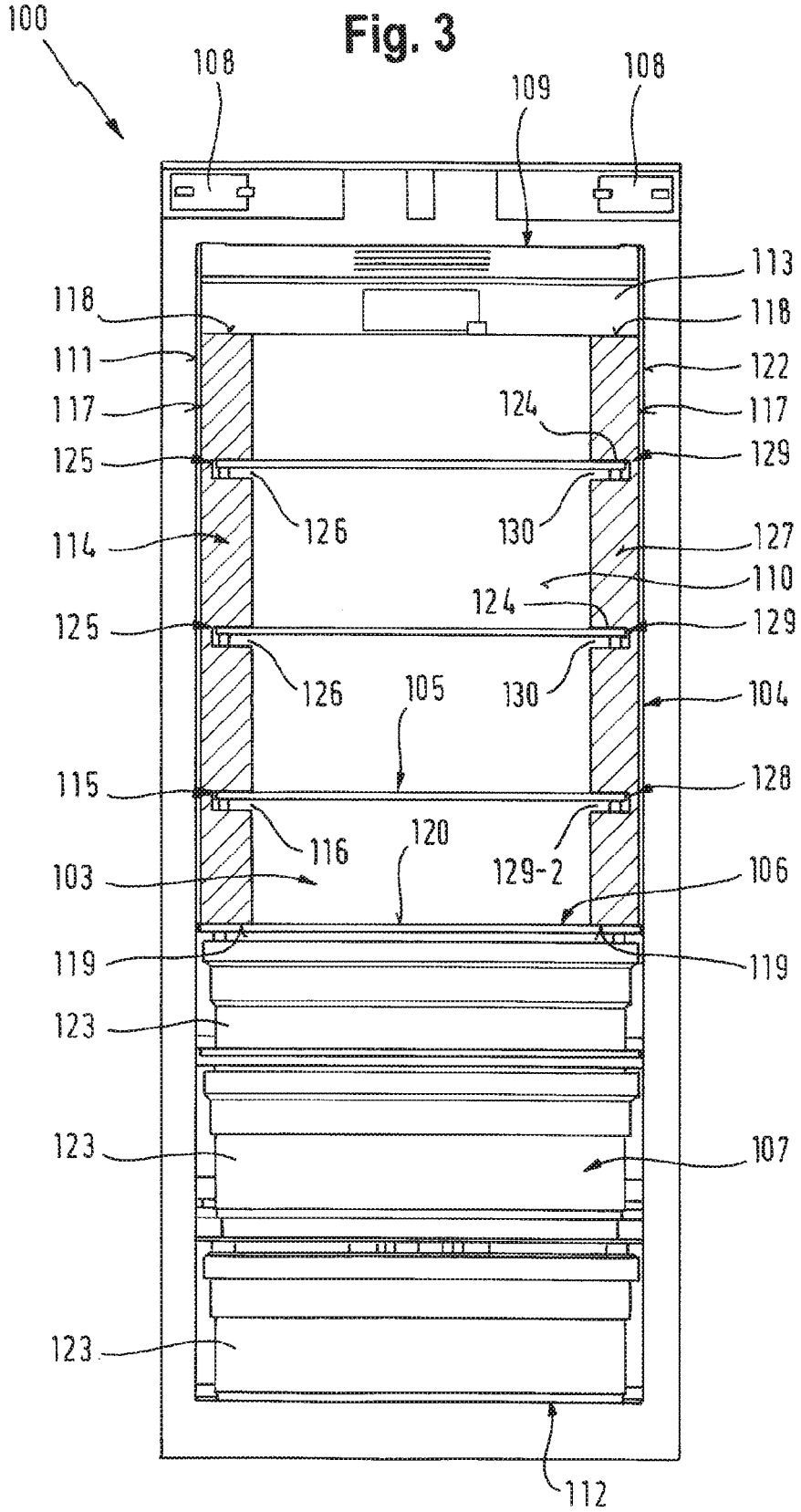
FIG. 3 shows a schematic representation of a cooling chamber of a refrigeration device in front view.

FIG. 3 shows a schematic representation of a cooling chamber of a refrigeration device according to FIG. 2 in front view, comprising a heat-insulated inner container 104, which delimits a cooling chamber 103. The inner container 104 comprises a top container wall 109, a rear container wall 110, a lateral container wall 111, a bottom container wall 112, as well as an additional lateral container wall 122 opposite to the lateral container wall 111.

An evaporator cover sheet 113 is mounted on the top container wall 109. A bottom shelf 106, which is fixed to the inner container 104, encloses a bottom cooling space 107 of the cooling chamber 103. In the bottom cooling space 107 several refrigeration drawers 123 are positioned, which allow for a separate storage of specific refrigerated goods, such as vegetables or fruits.

Refrigerated goods can be placed on a shelf 105 as well as on further shelves 124, which are mounted on the inner container 104. To protect the shelf 105 and the further shelves 124, which may partially consist of glass, a transport securing element 114 is positioned between a lateral shelf edge 115 of the shelf 105, e.g. between the further lateral shelf edges 125 of the further shelves 124 and the lateral container wall 111. The transport securing element 114 comprises a recess 116, which is configured to enclose the lateral shelf edge 115. The transport securing element 114 comprises further recesses 126, which are configured to enclose the further lateral shelf edges 125.

To efficiently protect the shelf 105 and the further shelves 124 from both sides, an additional transport securing element 127 is positioned between an additional lateral shelf edge 128 of the shelf 105, e.g. between the further additional lateral shelf edges 129 of the further shelves 124 and the additional lateral container wall 122. The additional transport securing element 127 comprises an additional recess 129-2, which is configured to enclose the additional lateral shelf edge 128. The additional transport securing element 127 comprises additional further recesses 130, which are configured to enclose the further additional lateral shelf edges 129 of the further shelves 124

The transport securing element 114 and the additional transport securing element 127 each comprises a lateral side 117, which abuts against the lateral container wall 111 or additional lateral container wall 122, respectively, each comprises a top surface 118, which abuts against the evaporator cover sheet 113, and each comprise a bottom surface 119, which abuts against an upper surface 120 of the bottom shelf 106.

Figure 4:
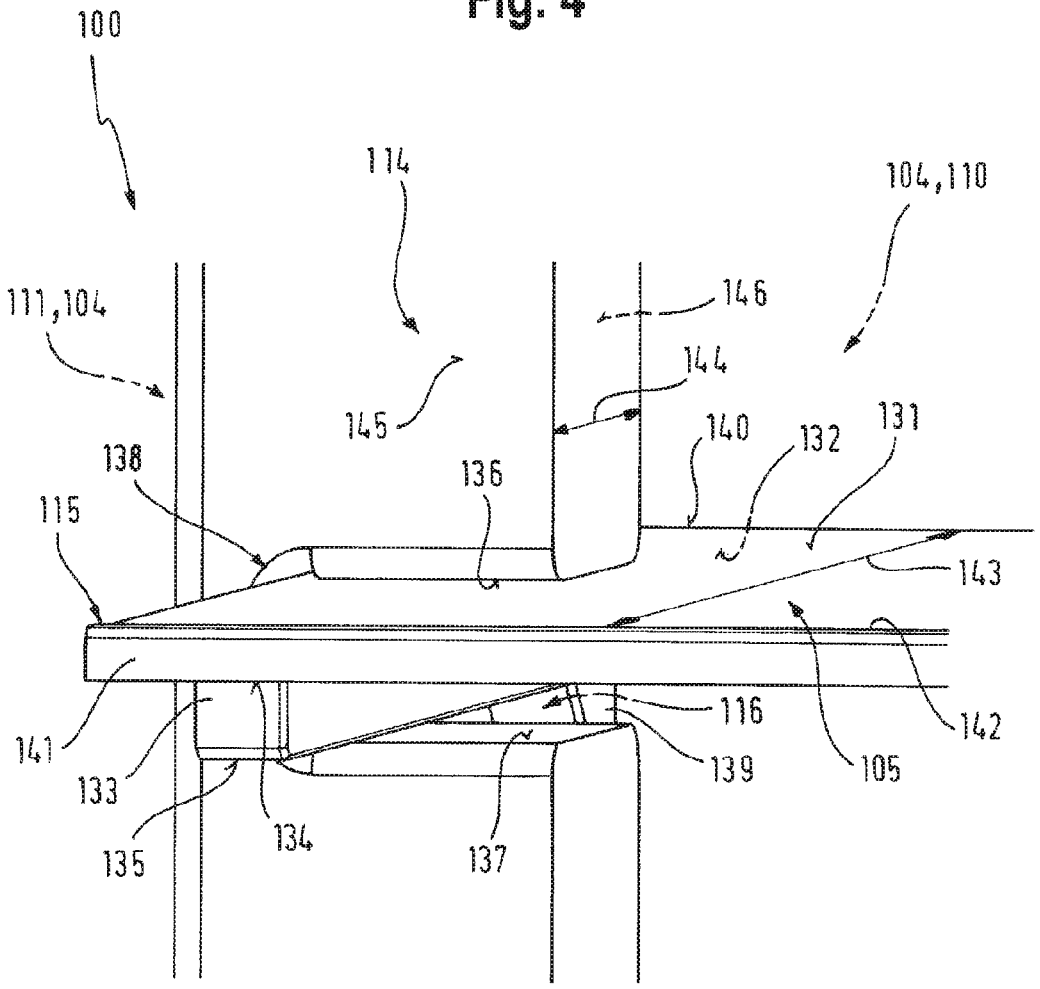
FIG. 4 shows a schematic representation of a transport securing element enclosing a shelf of a refrigeration device.

FIG. 4 shows a schematic representation of a transport securing element enclosing a shelf of a refrigeration device. The transport securing element 114 is positioned between a lateral container wall 111 of the inner container 104 and a lateral shelf edge 115 of the shelf 105. The transport securing element 114 comprises a recess 116, which is configured to enclose the lateral shelf edge 115 of the shelf 105.

The shelf 105 comprises an upper surface 131 and a lower surface 132. The shelf 105 further comprises a shelf bar 133 with an upper surface 134, which is connected to the lower surface 132 of the shelf 105, and a lower bar side 135.

The recess 116 comprises an upper wall 136, which abuts against the upper surface 131, and comprises a lower wall 137, which abuts against the shelf bar 133, in particular against the lower surface 135 of the shelf bar 133. The recess 116 further comprises an inner wall 138, which abuts against the lateral shelf edge 115 of the shelf 105.

Therefore, the recess 116 efficiently encloses the lateral shelf edge 115 of the shelf 105 and by the recess walls 136, 137 efficiently presses against the upper surface 131 of the shelf 105 and the shelf bar 133, respectively. Therefore, the transport securing element 114 not only protects the shelf 105, but also the shelf bar 133 from any potential damage.

The shelf 105 further comprises a shelf mount 139, which is configured to mount the shelf 105 on a rear container wall 110 of the inner container 104. The shelf mount 139 is hereby connected to the lower surface 132 and a rear edge 140 of the shelf 105.

The shelf 105 further comprises a deco strip 141, which is positioned at a front edge 142 of the shelf 105. The transport securing element 114 is in depth direction located behind the deco strip 141, in particular does not contact the deco strip 141.

The shelf 105 further comprises a lateral extension 143 between the front edge 142 and the rear edge 140 of the shelf 105. The transport securing element 114 comprises a lateral extension 144 between a front side 145 and a rear side 146 of the transport securing element 114. The lateral extension 144 is smaller than the lateral extension 143, thereby allowing the transport securing element 114 to be positioned between the front edge 142 and the rear edge 140 at the lateral shelf edge 115. Therefore, the transport securing element 114 can be efficiently fit into the cooling chamber 103.

Figure 5:
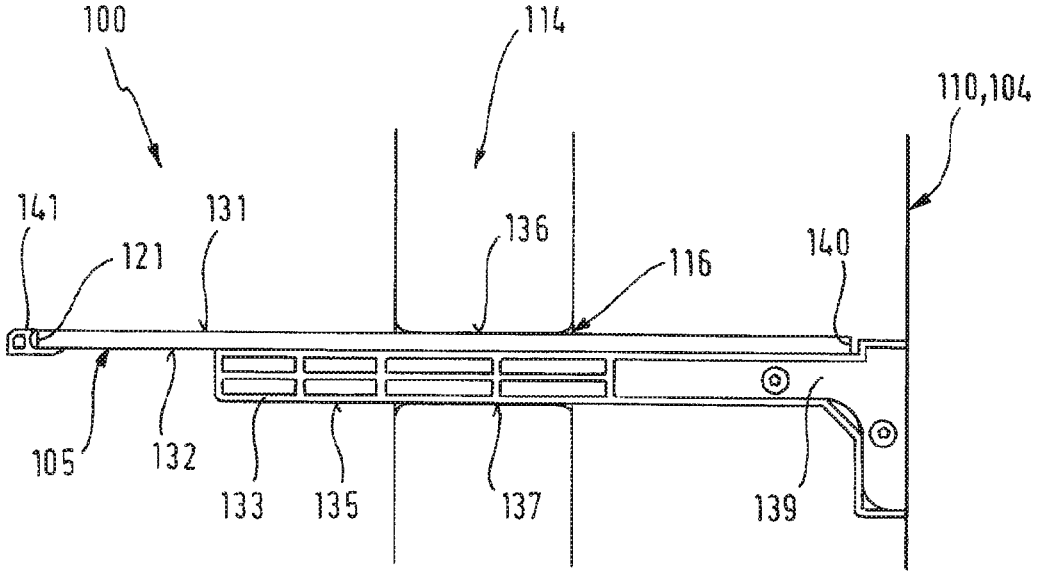
FIG. 5 shows a schematic representation of a transport securing element enclosing a shelf of a refrigeration device in side view.

FIG. 5 shows a schematic representation of a transport securing element enclosing a shelf of a refrigeration device in side view in respect to FIG. 4.

The transport securing element 114 comprises a recess 116 with an upper wall 136, which abuts against a upper surface 131 of a shelf 105, and with a lower wall 137, which abuts against a shelf bar 133, in particular against the lower bar side 135 of the shelf bar 133. The recess 116 further comprises an inner wall 138, which abuts against a lateral shelf edge 115 of the shelf 105, both of which are not depicted in FIG. 5.

The shelf 105 further comprises a shelf mount 139, which is connected to the shelf bar 133, and which is configured to mount the shelf 105 on a rear container wall 110 of an inner container 104 of the refrigeration device 100. The shelf mount 139 is hereby connected to a lower surface 132 and a rear edge 140 of the shelf 105.

The shelf 105 further comprises a deco strip 141, which is positioned at a front edge 121 of the shelf 105.

While preferred embodiments of the disclosure have been described herein, many variations are possible which remain within the concept and scope of the disclosure. Such variations would become clear to one of ordinary skill in the art after inspection of the specification and the drawings. The disclosure therefore is not to be restricted except within the spirit and scope of any appended claims.

REFERENCE NUMBERS

100 Refrigeration device
101 Refrigerator door
102 Refrigerator casing
103 Cooling chamber
104 Heat-insulated inner container
105 Shelf
106 Bottom shelf
107 Bottom cooling space
108 Door hinge
109 Top container wall
110 Rear container wall
111 Lateral container wall
112 Bottom container wall
113 Evaporator cover sheet
114 Transport securing element
115 Lateral shelf edge
116 Recess
117 Lateral side
118 Top surface
119 Bottom surface
120 Upper surface of bottom shelf
121 Front edge
122 Additional lateral container wall
123 Refrigeration drawers
124 Further shelf
125 Further lateral shelf edge
126 Further recess
127 Additional transport securing element
128 Additional lateral shelf edge
129 Further additional lateral shelf edge
129-2 Additional recess
130 Additional further recess
131 Upper surface
132 Lower surface
133 Shelf bar
134 Upper surface
135 Lower bar side
136 Upper wall

137 Lower wall
138 Inner wall
139 Shelf mount
140 Rear edge
141 Deco strip
142 Front edge
143 Lateral extension
144 Lateral extension
145 Front side
146 Rear side

What is claimed is:

1. A refrigeration device having a heat-insulated inner container, which is configured to delimit a cooling chamber for storing refrigerated goods, wherein the inner container comprises a lateral container wall, the refrigeration device comprising:

a shelf mount mounted on the inner container;

a shelf mounted on the shelf mount for fixing the shelf to the inner container in a mounting position, the shelf including a lateral shelf edge, and a transport securing element for securing the shelf during transport of the refrigeration device with the shelf is mounted on the shelf mount in the mounting position, the transport securing element being positioned between the lateral container wall and the lateral shelf edge with the shelf is mounted on the shelf mount in the mounting position, and the transport securing element including a recess configured to enclose the lateral shelf edge with the shelf is mounted on the shelf mount in the mounting position.

2. The refrigeration device according to claim 1, wherein the recess includes an inner recess wall, which abuts against the lateral shelf edge.

3. The refrigeration device according to claim 1, wherein the shelf includes an upper surface and a lower surface, the shelf includes a shelf bar, which is positioned at the lower surface, the recess includes an upper wall, which abuts against the upper surface, and the recess includes a lower wall, which abuts against the shelf bar.

4. The refrigeration device according to claim 3, wherein the shelf bar includes an upper surface, which is connected to the lower surface of the shelf, and the lower wall abuts against a lower surface of the shelf bar.

5. The refrigeration device according to claim 1, wherein the shelf mount is disposed on a rear container wall of the inner container.

6. The refrigeration device according to claim 5, wherein the shelf includes a lower surface and a rear edge, and the shelf mount is connected to at least one of the lower surface or the rear edge.

7. The refrigeration device according to claim 1, wherein the transport securing element includes a lateral side, which abuts against the lateral container wall.

8. The refrigeration device according to claim 1, wherein an evaporator cover sheet for covering an evaporator chamber of the refrigeration device is mounted on a top container wall of the inner container, the transport securing element includes a top surface, which abuts against the evaporator cover sheet.

9. The refrigeration device according to claim 1, comprising a bottom shelf, which is fixed to the inner container, the transport securing element including a bottom surface abutting against an upper surface of the bottom shelf.

10. The refrigeration device according to claim 1, wherein the shelf includes a lateral extension between a front edge and a rear edge of the shelf, the transport securing element includes a lateral extension between a front side and a rear side of the transport securing element, and the lateral extension of the transport securing element is smaller than the lateral extension of the shelf.

11. The refrigeration device according to claim 1, wherein the shelf includes a deco strip, which is positioned at a front edge of the shelf.

12. The refrigeration device according to claim 1, comprising an additional transport securing element, the shelf including an additional lateral shelf edge opposite to the lateral shelf edge, the inner container including an additional lateral container wall opposite to the lateral container wall, the additional transport securing element being positioned between the additional lateral container wall and the additional lateral shelf edge, and the additional transport securing element including an additional recess being configured for enclosing the additional lateral shelf edge.

13. The refrigeration device according to claim 1, wherein the transport securing element is made at least partially of plastic.

14. The refrigeration device according to claim 1, comprising a further shelf mounted on the inner container, the transport securing element being positioned between the lateral container wall and a further lateral shelf edge of the further shelf, and the transport securing element including a further recess, which is configured to enclose the further lateral shelf edge.

15. The refrigeration device according to claim 12, comprising a further shelf mounted on the inner container, the additional transport securing element being positioned between the additional lateral container wall and a further additional lateral shelf edge of the further shelf, and the additional transport securing element including an additional further recess configured for enclosing the further additional lateral shelf edge.

16. A refrigeration device comprising:

a heat-insulated inner container delimiting a cooling chamber, said inner container including a lateral container wall;

a shelf mount mounted on the inner container;

a shelf having a lateral shelf edge, said shelf being mounted on said shelf mount for fixing the shelf to the inner container in a mounting position defining a lateral gap between said lateral container wall and said lateral shelf edge;

a transport securing element for securing said shelf during transport of the refrigeration device, said transport securing element having a recess defined by a wall portion, said wall portion being disposed in said lateral gap between the lateral container wall with said recess receiving said lateral shelf edge in the mounting position.

* * * * *